US006790121B2

(12) United States Patent
Llorens

(10) Patent No.: US 6,790,121 B2
(45) Date of Patent: Sep. 14, 2004

(54) DOLL WHICH IS RESTLESS AND URINATES AFTER DRINKING BABY BOTTLE

(75) Inventor: Jaime Ferri Llorens, Onil (ES)

(73) Assignee: Onilco Innovacion, S.A., Onil (Alicante) (ES)

( * ) Notice: Subject to any disclaimer, the term of this patent is extended or adjusted under 35 U.S.C. 154(b) by 289 days.

(21) Appl. No.: 09/755,410

(22) Filed: Jan. 5, 2001

(65) Prior Publication Data

US 2001/0029146 A1 Oct. 11, 2001

(30) Foreign Application Priority Data

Apr. 7, 2000 (ES) ..... P200000914

(51) Int. Cl.[7] ..... A63H 3/24
(52) U.S. Cl. ..... 446/305; 446/298; 446/354
(58) Field of Search ..... 446/296, 298, 446/305, 354, 355

(56) References Cited

U.S. PATENT DOCUMENTS 3,641,703 A * 2/1972 Tepper et al.
3,959,919 A * 6/1976 Baulard-Cogan
4,160,338 A * 7/1979 Lyons et al.
5,083,965 A * 1/1992 Mayem
5,094,644 A * 3/1992 Kelley

FOREIGN PATENT DOCUMENTS

| | | | |
|---|---|---|---|
| DE | 2059237 | * 6/1971 | ..... 446/305 |
| DE | 2113366 | * 10/1971 | ..... 446/305 |
| GB | 2230200 | * 10/1990 | ..... 446/305 |

* cited by examiner

*Primary Examiner*—John A. Ricci
(74) *Attorney, Agent, or Firm*—Ladas & Parry

(57) ABSTRACT

This comprises a mechanical system (1) and a pneumatic system (3) that are interconnected to perform three phases. In the first one a walking mechanism is activated consisting of an oscillating plate (77) connected to the doll's legs. The second phase takes place when the doll is supplied with air and water through the mouth (43), connected by tubes (44) to a pneumatic accumulator (24) and an output valve (45) capable of being manually placed in an opened or closed position. During this phase, the doll repeatedly moves its hand towards its crotch, while it changes from walking to a restless movement, accomplished thanks to the alternating axial movement from a moveable toothed crown (12) and to the dissipation of energy in an arm clutch (29). The third phase consists in the ejection through the output valve (45) of a squirt of pressurized water, previously stored in the pneumatic accumulator.

18 Claims, 5 Drawing Sheets

DOLL WHICH IS RESTLESS AND URINATES AFTER DRINKING BABY BOTTLE

FIELD OF THE INVENTION

The present invention refers to a doll which, having mechanical, electrical and pneumatic systems, simulates certain complex actions without its internal organs being affected by the use of water.

BACKGROUND OF THE INVENTION

Dolls that urinate after administering water to them through the mouth are well known. However, all embodiments fail in having a high risk of leakage from the internal storage water devices, which conflicts with the ever more frequent use of electrical and electronic devices. Another frequent problem is that making the flow of water which simulates the doll's urine to have a certain pressure demands the use of a second electric motor to pump the water to the exterior, which clearly complicates the product and makes it more expensive.

Document U.S. Pat. No. 3,839,819 describes a doll that urinates in which a container is used that is previously filled with water, associated to a double-effect, intake-output pump which must be manually activated by the user in an unrealistic way.

Document U.S. Pat. No. 4,115,948 describes a doll that urinates in which it is necessary to manually withdraw the water container from the inside of the doll once it is full, and then connect it again to the output conduct.

Document U.S. Pat. No. 4,160,338 uses a pneumatic accumulator, but it must be filled with air by means of a second bellows that is activated patting the doll's back, which involves the need of coordinating various operations (the feeding and the patting).

BRIEF SUMMARY OF THE INVENTION

One objective of the present invention is to have a doll in which the volume of water it can receive is small and automatically limited.

Another objective of the present invention is to have a doll in which the necessary pressure to simulate the action of urinating is automatically generated in the same operation of water intake.

And another objective of the present invention is to have a doll in which an alternative restless movement or walking movement can be obtained in a simple and economical way, using only one electrical motor.

To obtain the proposed objectives the doll of the invention comprises a mechanical system, an electronic system, and a pneumatic system.

The mechanical system starts with an electric motor that operates an already known conventional walking device, as well as an arm clutch that causes the flexing of the elbow in one of the doll's arms simulating that it is moving its hand to its crotch, when an excessive consumption of energy is produced by the walking mechanism, so it transmits a restless movement to the doll. The alternating of the walking movement and the restless movement is produced by the action of the alternating axial movement of a moveable toothed wheel caused by the encounter with a circular cam with an axially fixed toothed crown, both receiving the movement from a common gear with both crowns presenting a slightly different angular speed, since, although receiving their movement from the same gear, the number of teeth they present is different by one unit.

The pneumatic system starts at the doll's mouth and it consists of a series of tubes that join it to a pneumatic accumulator and to an output valve that simulates the doll's penis and which is opened or closed according to the manually determined geometric position. The pneumatic accumulator is united to a pneumatic clutch that activates or deactivates the previously described transmission of alternating movement for the articulation of the elbow, in such a way that the doll's restless movement, associated with the moving of the hand to its crotch, only occurs when the pneumatic accumulator has been loaded with water and air by means of a special baby-bottle.

The conventional electronic system consists of a battery box, a speaker to emit different sounds adequate to each of the doll's activity phases and the corresponding electronic control circuit to synchronize it with the mechanical movements.

Figure 1:
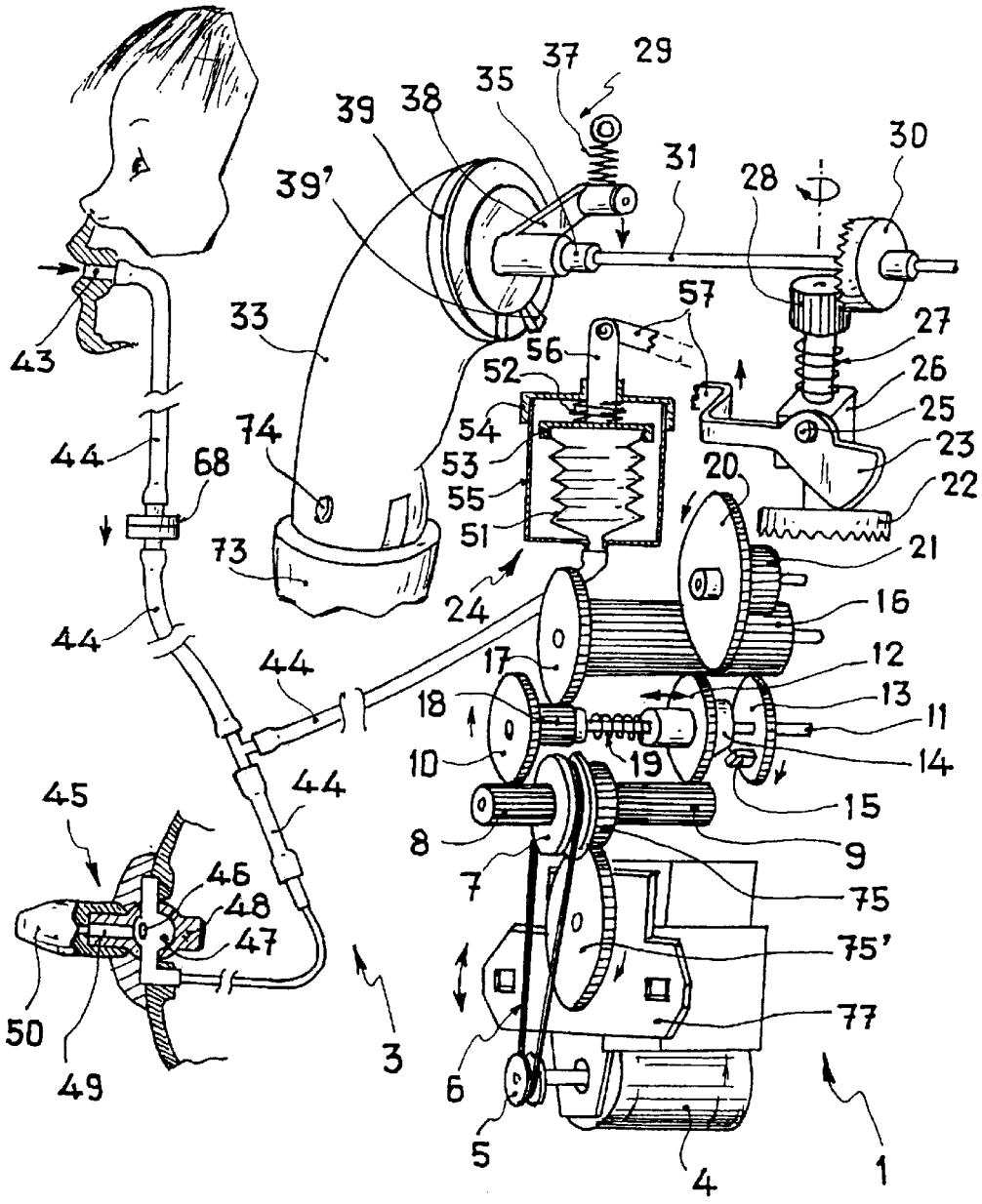
FIG. 1 schematically shows the doll's mechanical and pneumatic system object of the invention.
Figure 2:
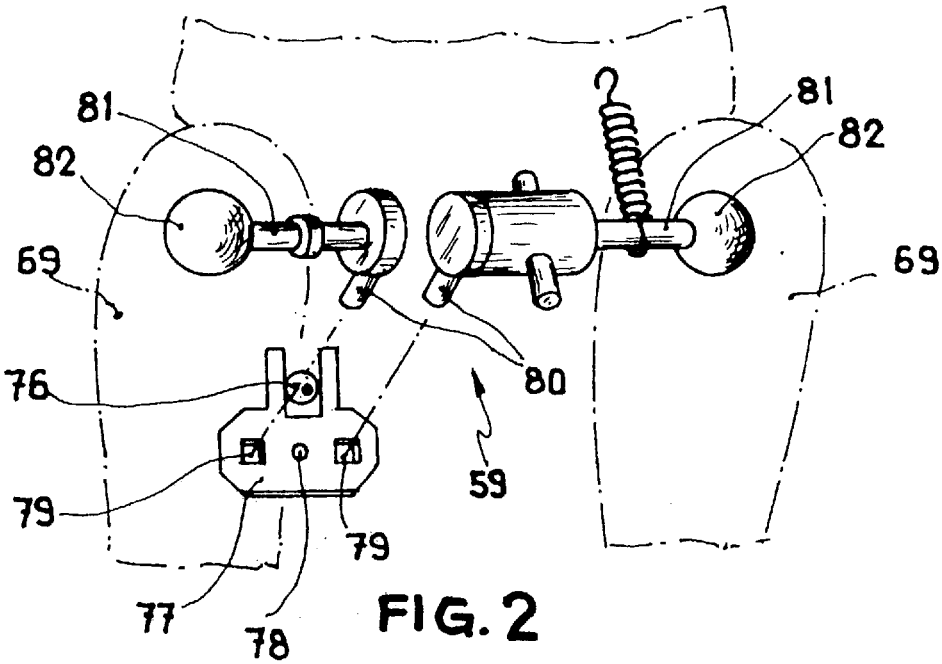
FIG. 2 shows a detail of the doll's walking mechanism object of the invention.

In these figures, the number references correspond to the following parts and elements:

1. Mechanical system
2. Electronic system
3. Pneumatic system
4. Electric motor
5. Drive pulley
6. Transmission belt
7. Receptor pulley
8. Receptor pulley gear
9. Walking mechanism gear
10. Alternating shaft crown
11. Alternating shaft
12. Alternating shaft's axially moveable toothed crown
13. Alternating shaft's fixed toothed crown
14. Moveable crown's circular cam
15. Fixed crown's circular cam
16. Drive gear
17. Drive gear's crown
18. Alternating shaft's gear
19. Alternating shaft's spring
20. Pneumatic clutch drive crown
21. Pneumatic clutch drive gear
22. Pneumatic clutch receptor crown
23. Pneumatic clutch sector
24. Pneumatic accumulator

25. Sector shaft
26. Fixed cube
27. Pneumatic clutch spring
28. Pneumatic clutch output gear
29. Arm clutch
30. Arm receptor crown
31. Arm shaft
32. Arm coupling
33. Flexible arm
34. Friction washer
35. Interior bushing
36. Exterior bushing
37. Arm spring
38. Coupling lever
39. Coupling receptor part
39'. Coupling receptor part butt end
40. Basic electronic circuit
41. Output speaker
42. Set of batteries
43. Doll's mouth
44. Pneumatic tubes
45. Outlet valve
46. Fixed interior conduct
47. Central spherical area
48. Exterior body
49. Moveable conduct
50. Elastic cylindrical body
51. Elastic bellows
52. Accumulator spring
53. Bellows cover
54. Accumulator cover
55. Accumulator box
56. Bellows cover rod
57. Sector prolongation
58. Main switch
59. Walking mechanism
61. Baby-bottle
62. Baby-bottle non-return valve
63. Valve's origin assembly
64. Valve's destination assembly
65. Valve's interior cavity
66. Valve's elastic disc
67. Non-return valve projections
68. Inlet non-return valve
69. Leg
70. Arm coupling stub
71. Arm connecting rod
72. Forearm prolongation
73. Forearm
74. Elbow pivot
75. Primary crown
75'. Secondary crown
76. Walker's eccentric
77. Flat plate
78. Walker's fixed shaft
79. Flat plate's side windows
80. Leg shaft radial prolongations
81. Leg shafts
82. Ball joints
100. Doll

DETAILED DESCRIPTION OF THE INVENTION

Figure 9:
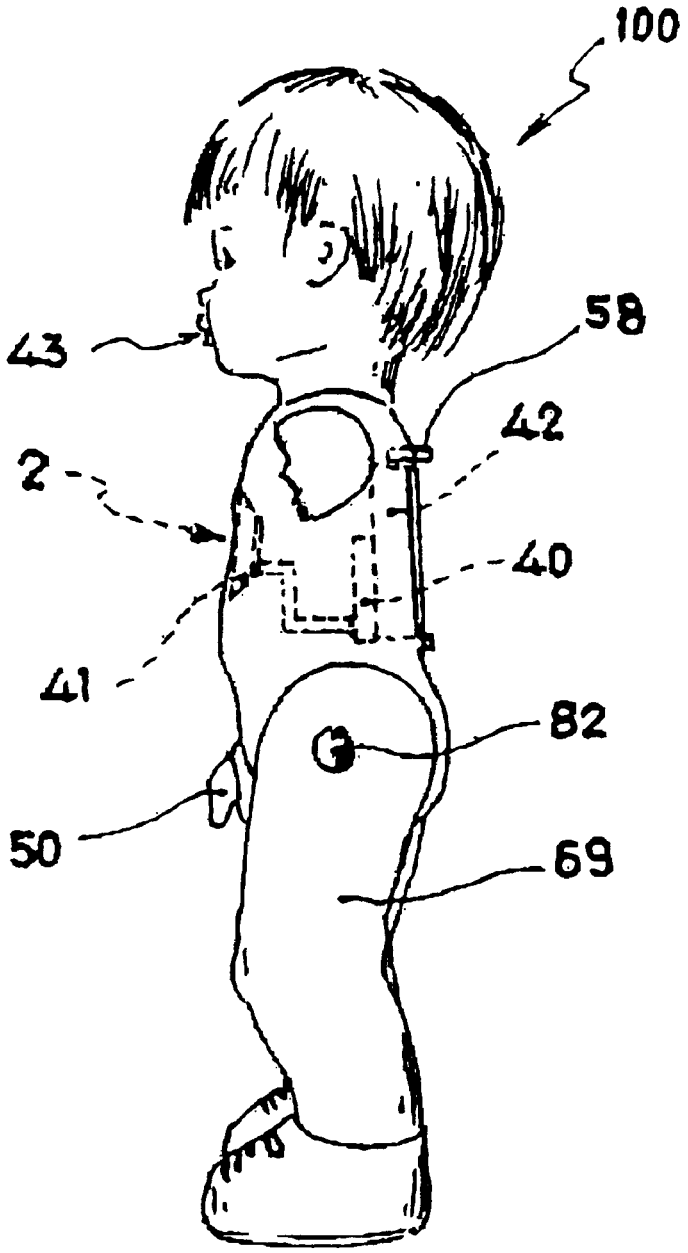
FIG. 9 shows a side view of the doll object of the invention.

As can be seen in FIGS. 1 and 9 the doll object of the invention has in its interior a mechanical system (1), an electronic system (2) and a pneumatic system (3).

The mechanical system consists of an electric motor (4) that transmits the movement from its drive pulley (5) by means of a belt (6) to a receptor pulley (7) connected to a shaft that has on one side a receptor pulley gear (8). On the receptor pulley gear (8) fits an alternating shaft crown (10) on the alternating shaft (11) of which can freely turn two toothed crowns (12) (13), whose number of teeth differ by one unit and that, having two opposing circular cams (14) (15) on its facing sides, they receive their movement from a long drive gear (16) connected to a drive gear crown (17) that fits into a an alternating shaft gear (18), that is likewise connected to the alternating shaft (11). In this way the moveable crown (12) and the fixed crown (13) freely turn on the alternating shaft (11) at slightly different speeds driven by the drive gear (16) in such a way that the moveable crown (12) is submitted to a large alternating period along the alternating shaft (11) itself, on which it freely turns depending on whether the opposing circular cams (14) (15) are facing each other or not. This axial movement on the alternating shaft (11) is accomplished against the action of an alternating shaft spring (19), that tends to bring both crowns (12) (13) nearer.

The movable crown (12) moves between two plans perpendicular to the alternating shaft (11), one of which coincides with that defined by a pneumatic clutch drive crown (20) connected to a pneumatic clutch drive gear (21) into which a pneumatic clutch receptor crown (22) fits at 90° when it is pushed by a pneumatic clutch sector (23), and that activated by a pneumatic accumulator (24) is articulated on a sector shaft (25) that has a fixed cube (26). A pneumatic clutch spring (27) that is supported on a pneumatic clutch output gear (28) and on the fixed cube (26) pushes both the pneumatic clutch receptor crown (22) and the pneumatic clutch output gear (28) upwards, maintaining the first item separated from the pneumatic clutch drive gear (21).

Figure 3:
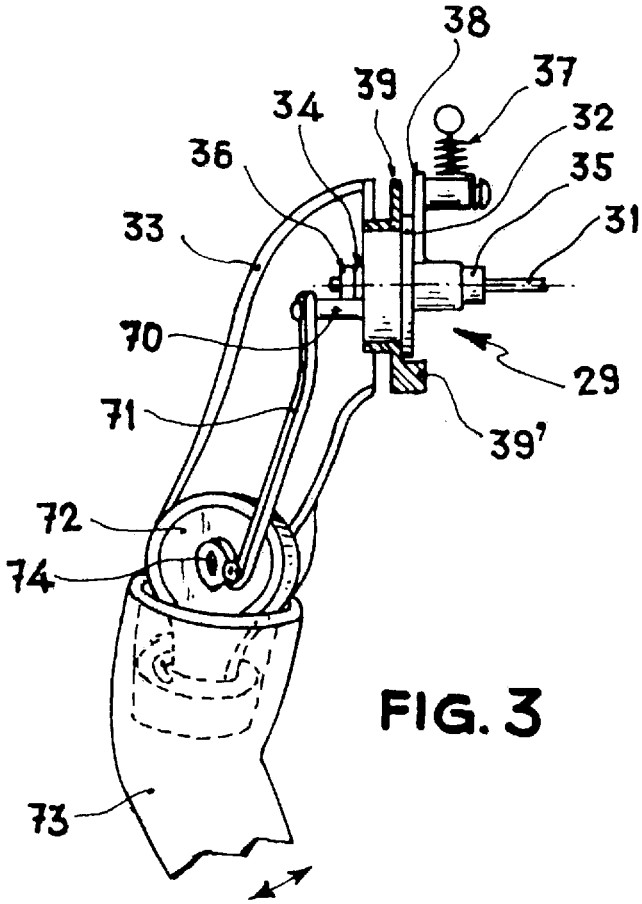
FIG. 3 shows a detail of the doll's arm clutch and movement of the elbow articulation object of the invention.

The mechanical system is completed with an arm clutch (29) (see FIGS. 1 and 3) consisting of an arm receptor crown (30) connected to an arm shaft (31) fitted permanently with the pneumatic clutch output gear (28). An arm coupling part (32) on which is mounted a flexible arm (33) can freely turn on the arm shaft (31) overcoming the produced friction against a friction washer that separates it from an interior bushing connected to the arm shaft (31). A second exterior bushing is mounted by pressure on the arm shaft (31) controlling the distance between both bushings (35) (36) in such a way that the arm coupling (32) and the friction washer (34) are locked between them. Thus, when the arm shaft (31) receives the movement from the arm receptor crown (30) and the pneumatic clutch output gear (28) draws the arm coupling (32) by friction until the coupling lever (38) connected to it hits against a butt end (39') fixed to a coupling receptor part (39) on the doll's torso.

The conventional electronic system (2) consists of a basic electronic circuit (40) with an output speaker (41), which is all fed, as well as the electric motor (4) by means of a set of batteries (42) (see FIG. 9).

The pneumatic system (3) starts at the doll's mouth (43) which is united by tubes (44) to an accumulator (24) and an outlet valve (45). This is made up of a fixed interior conduct (46) with a central spherical area (47) on which an exterior body (48) can turn, also having a moveable interior conduct (49) that can be facing the fixed interior conduct (46) or not. On the moveable interior conduct (49) an elastic cylindrical body (50) is mounted, simulating an infant's penis. The pneumatic accumulator (24) consists of an elastic bellows (51) capable of expanding against the action of an accumulator spring (52), located between a bellows cover (53) and the accumulator cover (54) that closes an accumulator box (55). The bellows cover (53) prolongs to a bellows cover rod

(56) that, sliding through the accumulator cover (54) articulately connects to a prolongation (57) on the pneumatic clutch sector (23). Notice that in FIG. 1 the sector prolongation (57) is represented cut off, in its two extreme positions, on the left, united to the rod (56) it is in the high position while on the right of the figure it is in a low position.

The operation of the device is as follows:

In a first phase, when a main switch (58) is closed the electric motor (4) is activated, which by means of the drive pulley (5), the transmission belt (6), the receptor pulley (7), the receptor pulley gear (8), the alternating shaft crown (10), the alternating shaft gear (18) and the drive gear (16), causes the turning of the moveable crown (12) and the fixed crown (13), with a slight difference of speeds due to the fact that the number of teeth differ by one unit. In this way, the moveable crown's circular cam (14) and the fixed crown's circular cam (15) change their relative position, causing an alternative movement of the moveable crown (12) between a fitted position with the pneumatic clutch receptor crown (20) and another disengaged parallel position. In any case, the pneumatic clutch output gear (28) does not move since the pneumatic clutch receptor crown (22) is separated from the pneumatic clutch drive gear (21) as it is submitted to an upwards stress caused by the action of the pneumatic clutch spring (27) on the pneumatic clutch output gear (28) itself. During this first phase the doll does not emit any sound while it walks, driven by the conventional walking mechanism (59) moved by a walking mechanism gear (9) connected to a receptor pulley (7).

The second operating phase takes place when water and air are supplied to the doll through the mouth (43) using a special flexible baby-bottle (61). This baby-bottle is designed to inject into the pneumatic accumulator (24) a minimum and absolutely controlled amount of water, which is achieved by installing on its base a non-return valve (62), consisting of two cylindrical bodies (63) (64) that define an interior cavity (65) in which an elastic disc (66) slides. This closes the valve when it rests on the origin assembly (63), while it lets water and air pass through when it rests on the destination assembly (64) since it does so on various projections that are inside it. Thus, the suction capacity of the baby-bottle (61) can be quite limited when its elastic walls are repeatedly pressed and released, which will assure that, after this operation, there will always be in the baby-bottle a very small amount of water. In this way the elastic bellows (51) expands when it fills with air, with a small amount of water remaining at the bottom of it and in the pneumatic tubes (44).

The system does not lose pressure due to the existence of a non-return valve (68) located on the pneumatic tube (44) near to the doll's mouth (43) and also because the outlet valve (45) remains closed. Consequently, the bellows cover rod (56) moves upwards making the sector (23) turn and it applies the pneumatic clutch receptor crown (22) against the pneumatic clutch drive gear (21), fitting both together. This allows the pneumatic clutch output gear (28) to turn when the moveable toothed crown (12) fits with the pneumatic clutch drive crown (20) in its alternating movement on the alternating shaft (11) itself transmitting a turning movement to the arm coupling (32), through the arm receptor crown (30), the arm shaft (31) and the friction washer (34), the turning of which will not stop until the coupling lever (38) hits against the butt end (39') when the movement of the friction washer (34) will be produced and the arm spring (37) will have reached its maximum extended position. When the moveable crown (12) disengages from the pneumatic clutch drive crown (20) in the alternating movement of the former, the entire mechanical system from the latter up to the arm coupling (32) is freed, so the arm spring (37) will make the arm coupling (32) turn until it reaches its initial position. Consequently, the effect is that the doll repeatedly moves its hand to its crotch. Since in this position of the arm the arm clutch (29) is moving, the consumption of the electric motor (4) increases considerably, thus lowering the speed of the walking device (59) that can no longer make the doll walk, only transmitting an oscillating movement that simulates restlessness. During this second phase and while the doll moves its hand to its crotch, it emits a sound such as "mommy, pee . . . pee," or something similar.

Figure 4:
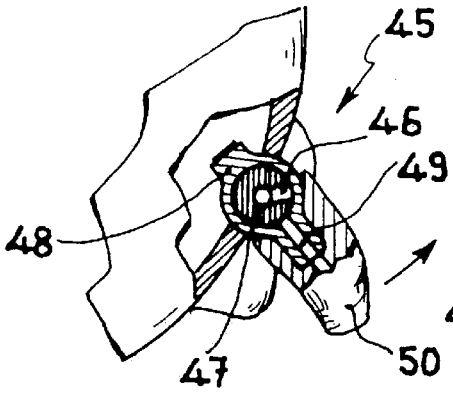
FIG. 4 shows a section of the outlet valve in the closed position.
Figure 5:
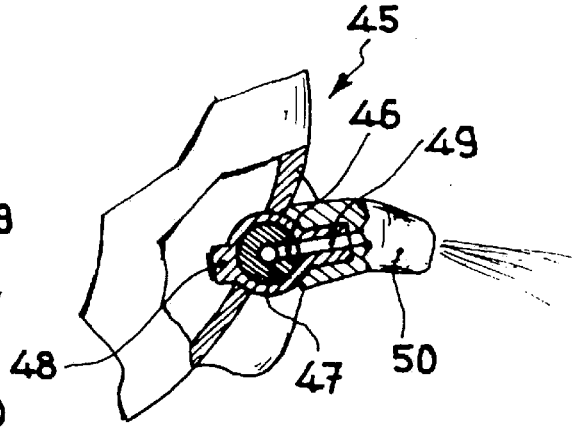
FIG. 5 shows a shows a section of the outlet valve in the opened position.
Figure 6:
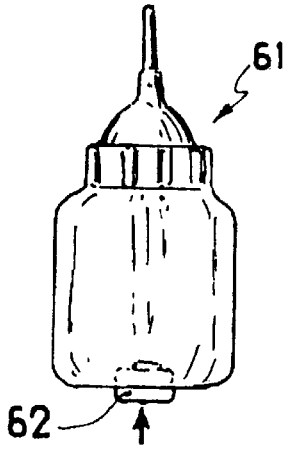
FIG. 6 shows the special baby-bottle to "feed" the doll water and air.
Figure 7:
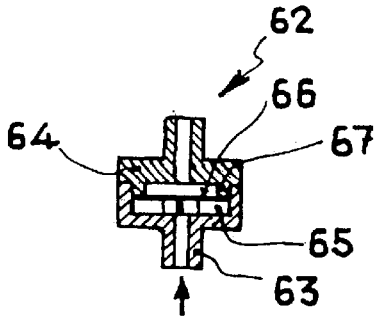
FIG. 7 shows a section of the non-return valve in the special baby-bottle.
Figure 8:
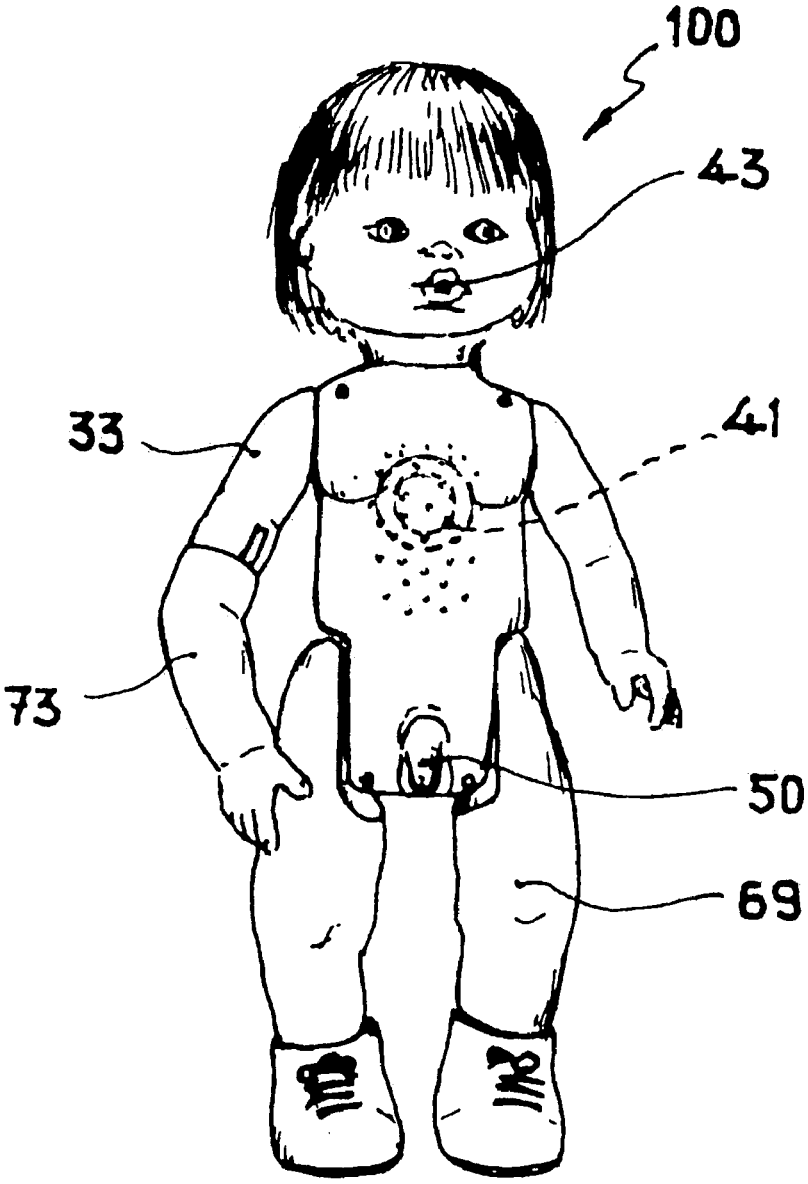
FIG. 8 shows a front view of the doll object of the invention.

The third phase takes place when once the user has taken the doll's clothes off, lifts the elastic cylindrical body (50) from the position represented in FIG. 4, to the position represented in FIG. 5, making the outlet valve (45) go from a closed position to an opened one and the retained water in the interior of the pneumatic tubes (44) is expelled to the exterior with force under the action of the overpressure created in the elastic bellows (51) by the accumulator spring (52) simulating that the doll is urinating. It is of interest to point out that this third phase can be accomplished with the doll moving or static, whether the main switch (58) is kept connected or not. During this third phase, the doll emits the sound of passing water "drip . . . drip . . . drip."

When the arm shaft (31) turns, a stub (70) eccentrically mounted on the arm coupling (32) also does so, transmitting a translation movement to an arm connecting rod (71) that articulates on it and that also ends eccentrically articulated on a prolongation (72) of the forearm (73) that can turn around an elbow pivot (74) on the arm (33). See FIG. 3.

The walking mechanism (59) is already known from the application of the prior Utility Model U9002535 from the same applicant, so a very superficial description of its operation will be done. The walking mechanism gear (9) is connected to a primary crown (75), fitted into a secondary crown (75'), likewise connected to an eccentric (76) encased between the "U" branches of a flat plate (77), itself oscillating on a fixed shaft (78). The movement of the walking mechanism gear (9) is produced continuously, for which we will also continuously have an oscillating movement of the flat plate (77), that will be accomplished at two different speeds, depending on whether the arm clutch (29) is moving or not. This flat plate (77) has two side windows (79) designed to receive the radial prolongations (80) of each leg shafts (81) finishing in a ball joint (82) on which the legs (69) themselves are mounted.

With the objective to simplify, to the degree possible, the description of a preferred embodiment and maintain relatively controlled the number of references to the figures, only those elements have been described that are essential to characterize the invention, omitting the electrical schematic or the synchronizing between the electrical and pneumatic systems. Which will be performed preferably by means of magnets connected to the moving elements and fixed Reed relays, such as is usual and will be perfectly known, to any expert on the matter.

What is claimed is:

1. A doll capable of moving, emitting sound, and urinating after drinking, comprising:

a head, a body and limbs;

a mechanical system that activates movements of the head, body and limbs;

an electronic system inside the body;

a pneumatic system inside the body, comprising a mouth;

an outlet valve simulating an infant's genital;

a pneumatic accumulator; and a T-shaped tube system; wherein a first end of the tube system is connected to the mouth, a second end of the tube system is connected to the outlet valve, and a third end of the tube system is connected to the pneumatic accumulator;

wherein when the mouth is supplied with a pre-determined amount of water, the mechanical system propels the doll's hands moving toward the outlet valve;

the mechanical system generates an oscillating movement of the body, simulating an infant's restlessness;

the electronic system emits a sound simulating an infant's cry of mommy and pee; and the outlet valve moves and emits water, simulating an infant's urination.

2. The doll according to claim 1, wherein the mechanical system comprises:

an electric motor, a driving pulley and a belt;

a receptor pulley propelled by movement the electric motor via the driving pulley and the belt;

an alternating shaft crown propelled by movement of the receptor pulley, comprising an alternating shaft with two toothed crowns, wherein the number of teeth of the two toothed crowns differs by one unit; and two opposing circular cams that propels movement of a long drive gear;

a drive gear crown connected to the long drive gear that fits into the alternating shaft gear, so that the movable tooth crowns move between two positions perpendicular to the alternating shaft to propel movements of an arm clutch and a pneumatic clutch.

3. The doll according to claim 2, wherein the arm clutch comprises:

an arm receptor crown;

an arm shaft connected to the arm receptor crown and propelled by movement of the arm receptor crown;

an arm coupling propelled by friction from movement of the arm shaft;

a coupling lever connected to the arm coupling so that when the coupling lever hits against a fixed butt end, the coupling level stops movement of the arm coupling.

4. The doll according to claim 1, wherein the electronic system comprising a basic electronic circuit, a set of batteries and a speaker.

5. The doll according to claim 1, wherein the pneumatic accumulator comprises:

an elastic bellows capable of expanding and contracting, with a first end connected to the tube system, and a second and covered by a bellows cover;

an accumulator box surrounding the elastic bellows;

an accumulator cover covering the opening of the accumulator box;

a bellows cover rod extending through a hole of the accumulator cover, with a first end connected to the bellows cover, and a second end connected to a pneumatic clutch sector via a sector prolongation; and an accumulator spring located bellows cover and the accumulator cover, surrounding the lower part bellows cover rod.

6. The doll according to claim 1, wherein the outlet valve comprises:

a fixed interior conduit having a central spherical area;

an exterior body having a movable interior conduit;

an elastic cylindrical body mounting over a front part of the movable interior conduit.

7. The doll according to claim wherein the pneumatic system is adapted to be fed with air and water by means of a flexible baby-bottle which has a non-return valve on a base o the bottle.

8. The doll according to claim 7, wherein the non-return valve comprises:

an origin assembly;

a destination assembly having projections; and a slidable elastic disc inside a cavity between the origin assembly and the destination assembly, wherein when the elastic disc is slided toward the origin assembly, the valve does not let water and air pass through; and when the elastic disc is slided toward the destination assembly, the valve lets water and air pass through due to the projections.

9. A doll capable of moving, emitting sound, and urinating after drinking, comprising:

a head, a body and limbs;

a mechanical system that activates movements of the head, body and limbs;

an electronic system inside the body;

a pneumatic system inside the body, comprising a mouth, which is united through a non-return valve by a T-shaped tube system to an outlet valve simulating an infant's genital and to a pneumatic accumulator; wherein the pneumatic accumulator is charged by an accumulator spring; and when the mouth is supplied with a pre-determined amount of water, the mechanical system propels the doll's hands moving toward the outlet valve;

the mechanical system generates an oscillating movement of the body, simulating an infant's restlessness;

the electronic system emits a sound simulating an infant's cry of mommy and pee; and when the outlet valve is moved towards an opening position it emits water under pressure which is caused by the accumulator spring simulating an infant's urination.

10. The doll according to claim 9, wherein the T-shaped tube system has a first end of the tube system connected to the mouth through a non-return valve, a second end of the tube system connected to the outlet valve, and a third end of the tube system connected to the pneumatic accumulator.

11. A doll capable of moving, emitting sound, and urinating after drinking, comprising:

a head, a body and limbs;

a mechanical system that activate movements of the head, body and limbs;

an electronic system inside the body;

a pneumatic system inside the body, comprising a mouth and an outlet valve simulating an infant's genital; wherein when the mouth is supplied with a pre-determined amount of water, the mechanical system propel the doll's hands moving toward the outlet valve;

the mechanical system generates an oscillating movement of the body, simulating an infant's restlessness;

the electronic system emits a sound simulating an infant's cry of mommy and pee; and the outlet valve moves and emits water, simulating an infant's urination;

wherein the pneumatic system is adapted to be fed with air and water by means of a flexible baby bottle which has a non-return valve on a base of the bottle.

12. The doll according to claim 11, wherein the mechanical system comprises:

an electric motor, a driving pulley and a belt;

a receptor pulley propelled by movement of the electric motor via the driving pulley and the belt;

an alternating shaft crown propelled by movement of the receptor pulley, comprising an alternating shaft with two toothed crowns, wherein the number of teeth of the two toothed crowns differs by one unit; and two opposing circular cams that propels movement of a long drive gear;

a drive gear crown connected to the long drive gear that fits into the alternating shaft gear, so that the movable toothed crowns move between two positions perpendicular to the alternating shaft to propel movements of an arm clutch and a pneumatic clutch.

13. The doll according to claim 12, wherein the arm clutch comprises:

an arm receptor crown;

an arm shaft connected to the arm receptor crown and propelled by movement of the arm receptor crown;

an arm coupling propelled by friction from movement of the arm shaft;

a coupling lever connected to the arm coupling so that when the coupling lever hits against a fixed butt end, the coupling level stops movement of the arm coupling.

14. The doll according to claim 11, wherein the electronic system comprising a basic electronic circuit, a set of batteries and a speaker.

15. The doll according to claim 11, wherein the pneumatic system further comprising a pneumatic accumulator; and a T-shaped tube system; wherein a first end of the tube system is connected to the mouth, a second end of the tunnel system is connected to the outlet valve, and a third end of the tube system is connected to the pneumatic accumulator.

16. The doll according to claim 15, wherein the pneumatic accumulator comprises:

an elastic bellows capable of expanding and contracting, with a first end connected to the tube system, and a second end covered by a bellows cover;

an accumulator box surrounding the elastic bellows;

an accumulator cover covering the opening of the accumulator box;

a bellows cover rod extending through a hole of the accumulator cover, with a first end connected to the bellows cover, and a second end connected to a pneumatic clutch sector via a sector prolongation; and an accumulator spring located between the bellows cover and the accumulator cover, surrounding the lower part of the bellows cover rod.

17. The doll according to claim 11, wherein the outlet valve comprises:

a fixed interior conduit having a central spherical area;

an exterior body having a movable interior conduit;

an elastic cylindrical body mounting over a front part of the movable interior conduit.

18. The doll according to claim 11, wherein the non-return valve comprises:

an origin assembly;

a destination assembly having projections; and a slidable elastic disc inside a cavity between the origin assembly and the destination assembly, wherein when the elastic disc is slided toward the origin assembly, the valve does not let water and air pass through; and when the elastic disc is slided toward the destination assembly, the valve lets water and air pass through due to the projections.

* * * * *